US008646972B2

(12) United States Patent
Tanaka et al.

(10) Patent No.: US 8,646,972 B2
(45) Date of Patent: Feb. 11, 2014

(54) ZIPPER TAPE AND PACKAGING BAG WITH ZIPPER TAPE

(75) Inventors: Kenichi Tanaka, Tokyo (JP); Tomohiko Tamaoki, Sodegaura (JP)

(73) Assignee: Idemitsu Unitech Co., Ltd., Tokyo (JP)

( * ) Notice: Subject to any disclaimer, the term of this patent is extended or adjusted under 35 U.S.C. 154(b) by 171 days.

(21) Appl. No.: 13/060,813

(22) PCT Filed: Aug. 25, 2009

(86) PCT No.: PCT/JP2009/064772

§ 371 (c)(1),
(2), (4) Date: Feb. 25, 2011

(87) PCT Pub. No.: WO2010/024241

PCT Pub. Date: Mar. 4, 2010

(65) Prior Publication Data

US 2011/0150370 A1 Jun. 23, 2011

(30) Foreign Application Priority Data

Aug. 26, 2008 (JP) ..... 2008-216880

(51) Int. Cl.
*B65D 33/16* (2006.01)
*B65D 33/00* (2006.01)
*A44B 1/04* (2006.01)

(52) U.S. Cl.
USPC ..... 383/61.2; 383/203; 383/63; 24/400

(58) Field of Classification Search
USPC ..... 383/61.2, 63, 203, 204, 207–209; 24/399, 400, 585.12, DIG. 38–DIG. 41
See application file for complete search history.

(56) References Cited

U.S. PATENT DOCUMENTS 4,995,638 A 2/1991 Shinto et al.
5,647,671 A 7/1997 May et al.
5,660,479 A * 8/1997 May et al. ..... 383/204
5,664,303 A * 9/1997 Johnson ..... 24/585.12

(Continued)

FOREIGN PATENT DOCUMENTS

DE 3445272 A1 * 7/1986 ..... B65D 33/16
JP 08268442 A * 10/1996 ..... B65D 33/00

(Continued)

OTHER PUBLICATIONS

Supplementary European Search Report for EP 09 80 9892 dated Feb. 17, 2012.

(Continued)

*Primary Examiner* — Jes F Pascua
(74) *Attorney, Agent, or Firm* — Millen, White, Zelano & Branigan, P.C.

(57) ABSTRACT

A seal base, which is thicker than a thick portion and is bondable to an inner surface of a bag body, is continuously connected to one of belt-like bases of a zipper tape via a belt-like cutting portion that is thinner than the thick portion and separates a containing space from an outside. A first linking portion having a first corner (a) is defined by a cutting outer surface of the cutting portion and a seal outer continuous surface of the seal base. A second linking portion having a second corner (b) is defined by a contained cutting surface of the cutting portion and a contained seal continuous surface of the seal base.

14 Claims, 11 Drawing Sheets

(56) References Cited

U.S. PATENT DOCUMENTS

| | | | | |
|---|---|---|---|---|
| 2005/0286812 | A1* | 12/2005 | Sprague et al. | 383/61.2 |
| 2010/0014787 | A1* | 1/2010 | Katada et al. | 383/63 |
| 2010/0074562 | A1* | 3/2010 | Nanba et al. | 383/64 |

FOREIGN PATENT DOCUMENTS

| | | | |
|---|---|---|---|
| JP | 2003246332 | A | 9/2003 |
| JP | 200651987 | A | 2/2006 |
| JP | 2007269362 | A | 10/2007 |
| JP | 200824324 | A | 2/2008 |
| JP | 200844663 | A | 2/2008 |
| WO | 2004050487 | A2 | 6/2004 |

OTHER PUBLICATIONS

World IP Organization, "Translation—International Preliminary Report on Patentability and Written Opinion" PCT/JP2009/064772, Applicant: Idemitsu Unitech Co. Ltd., ISA: Japanese Patent Office, Authorized Officer: Masahi Honda; Mailed: Apr. 12, 2011.

World IP Organization, "International Search Report." PCT/JP2009/064772, Applicant: Idemitsu Unitech Co. Ltd., ISA: Japanese Patent Office, Mailed: Nov. 17, 2009.

Patent Abstracts of Japan. "English Abstract—Fitting Member and Packaging Bag with the Fitting Member." JP 200651987A, Applicant: C I Kasei Co Ltd, Feb. 23, 2006.

Patent Abstracts of Japan. "English Abstract—Bag with Zipper Tape and its Production Method." JP 2003246332A, Applicant: Dainippon Printing Co Ltd., Sep. 2, 2003.

Patent Abstracts of Japan. "English Abstract—Zipper Tape with Cut Tape, its Manufacturing Process and Packaging Bag with Zipper Tape." JP 200844663 A, Applicant: Idemitsu Unitech Co. Ltd. Feb. 28, 2008.

Patent Abstracts of Japan. "English Abstract—Packaging Bag with Fastener Tape." JP 200824324 A, Applicant: Idemitsu Unitech Co. Ltd., Feb. 7, 2008.

Patent Abstracts of Japan. "English Abstract—Packaging Bag and its Manufacturing Method." JP 2007269362 A, Applicant: Fujimori Kogyo Ltd, Oct. 18, 2007.

Japanese Patent Office. "Microfilm of the specification and drawings annexed to the request of JP Utility Model Application No. 170792/1988 (Laid-open No. 091052/1990)" (Toyota Motor Corp.) Jul. 19, 1990.

* cited by examiner

ZIPPER TAPE AND PACKAGING BAG WITH ZIPPER TAPE

TECHNICAL FIELD

The present invention relates to a zipper tape and a packaging bag with the zipper tape.

BACKGROUND ART

There has been typically known a packaging bag with a zipper tape (hereinafter occasionally abbreviated as a packaging bag) provided by bonding the zipper tape to an inner surface of the bag body. When such a packaging bag is filled with powdery substances or liquids as a content, the content may leak toward a top seal beyond the zipper tape during transportation. Accordingly, a zipper tape with a separating structure provided between the zipper tape and the content and a packaging bag with the zipper tape have been known for preventing leakage of the content (see Patent Literatures 1 to 3).

The separating structure provided to the zipper tape is exemplified by a cutting portion, a part of which can be easily cut, and a seal that is easily peelable from an inner surface of a bag body. In opening the packaging bag, the cutting portion is cut or peeled to take out the content.

Patent Literature 1 discloses a packaging bag including a wide seal base provided to a belt-like base of a male member near the content. The seal base includes a linear cutting portion. The packaging bag is sealed by the linear cutting portion being bonded to an end of a belt-like base of a female member. The linear cutting portion is cut by a force in opening the zipper tape, thereby opening the packaging bag.

Similarly, Patent Literature 2 discloses in FIG. 10 that a thin and linear cutting portion is provided to a belt-like base of a male member near a content and the cutting portion is cut to open the packaging bag.

Patent Literature 3 discloses that a connecting portion is provided as a cutting portion by connecting ends of non-opening-side-flanges of a male member and a female member of a joint to each other and the connecting portion is cut to open the packaging bag. Patent Literature 3 also discloses that a protrusion having a triangular cross section is formed on each of the ends of the male member and the female member, thereby allowing a stress to concentrate on the cutting portion.

CITATION LISTS

Patent Literatures

Patent Literature 1 JP-A-2008-24324

Patent Literature 2 International Publication No. WO2004/050487

Patent Literature 3 JP-A-2006-51987

SUMMARY OF THE INVENTION

Problems to be Solved by the Invention

In Patent Literatures 1 and 2, since the cutting portion is linearly formed, when the belt-like bases of the male and the female members or the seal base are sealed to the inner surface of the bag body, it is difficult to position the seal base and the cutting portion at a right place. Accordingly, the cutting portion may be directly bonded to the inner surface of the bag body, or the belt-like base and the seal base may be bonded to each other. In such a case, cuttability of the cutting portion is impaired.

In Patent Literature 3, unless at least one of the protrusions is fixed to a bag body film, forces enough to open the cutting portion may not be applied, so that the cutting portion is difficult to be cut.

An object of the invention is to provide an easily-openable zipper tape that is excellent in cuttability of a cutting portion and a packaging bag with the zipper tape.

Means for Solving the Problems

A zipper tape according to an aspect of the invention includes: a pair of a male member and a female member, each of the male member and the female member including an engaging portion capable of being engaged and disengaged to define a containing space inside a bag body and a belt-like base that is continuously connected to the engaging portion and bondable to an inner surface of the bag body, in which one of the belt-like bases of the male member and the female member is continuously connected to a seal base via a belt-like cutting portion at an end of the one of the belt-like bases near the containing space, the seal base being thicker than the one of the belt-like bases and bondable to the inner surface of the bag body, the cutting portion being thinner than the one of the belt-like bases and separating the containing space from an outside, and a liking portion between the cutting portion and the sea base near the containing space and a linking portion between the cutting portion and the seal base on the outside each have a corner.

In the above aspect of the invention, the cutting portion is shaped in a belt that is thinner than the belt-like bases. Accordingly, when the seal base and the one of the belt-like bases of the zipper tape are bonded to the inner surface of the bag body, as compared to the linearly-formed cutting portion, the cutting portion is likely to be less bondable to the inner surface of the bag body and the other of the belt-like bases that is opposed to the cutting portion. Accordingly, cuttability of the cutting portion is not impaired. Since the cutting portion is continuously connected to the seal base that is sealed to the inner surface of the bag body, the cutting portion receives sufficient stress when the cutting portion is cut. Accordingly, the cutting portion can be easily cut.

Since the linking portions of the zipper tape near the containing space and the outside are respectively provided with the corners, even when the cutting portion is shaped in a belt, in opening the bag, this arrangement prevents the resin from being supplied from the seal base to the cutting portion to cause the cutting portion to be stretched not to be cut. In other words, when the bag is opened, as compared to the arrangement without the corners, the stress easily concentrates on the linking portions to prevent the cutting portion from being extended. Accordingly, the cutting portion can be easily cut. Moreover, by providing the corners respectively to the linking portions near the containing space and the outside, the cutting portion is unlikely to contact with the inner surface of the bag body and the other of the belt-like bases that is opposed to the cutting portion. Accordingly, in sealing the seal base, the cutting portion is kept from being sealed to the inner surface of the bag body and the other of the belt-like bases that is opposed to the cutting portion.

The one of the belt-like bases, to which the seal base is provided via the cutting portion, may be either the belt-like base of male member or the belt-like base of female member.

Moreover, in the one of the belt-like bases to which the seal base is provided via the cutting portion, a width from the engaging portion to an end surface near the containing space may be the same as or different from that of the other of the belt-like bases.

In the zipper tape according to the aspect of the invention, it is preferable that the corners each have an angle of 110 degrees or less.

With this arrangement, since the corners respectively have specified angles, the cutting portion can be further kept from being bonded to the inner surface of the bag body. The respective corners may have the same or different angles.

In the zipper tape according to the aspect of the invention, it is preferable that, when the seal base, the belt-like base of the male member and the belt-like base of the female member respectively have a thickness of A, B1 and B2, A≥(B1+B2) is defined. The belt-like bases of the male and female members may have the same or different thickness.

With this arrangement, since the seal base is thicker than the total thickness of the belt-like bases of the male and female members, the seal base is reliably bonded to the inner surface of the bag body. Accordingly, the cutting portion is likely to receive the stress, when the bag is to be opened.

In the zipper tape according to the aspect of the invention, a thick portion is preferably provided at the end of the one of the belt-like bases near the containing space, the thick portion being thicker than the one of the belt-like bases.

With this arrangement, since the cutting portion is continuously connected to the thick portion, which is relatively thick, and the seal base, the stress applied in opening the bag is likely to further concentrate on the cutting portion, which facilitates cutting of the cutting portion.

In the zipper tape according to the aspect of the invention, it is preferable that a protrusion that is formed at the end of the one of the belt-like bases near the containing space protrudes toward an engagement-portion formation surface.

With this arrangement, when the zipper tape is sealed to the inner surface of the bag body, the protrusion prevents sealing of the one of the belt-like bases and the other of the belt-like bases. The protrusion may be plural or singular.

A packaging bag with a zipper tape according to another aspect of the invention includes: a bag body having an opening for defining a containing space; and the zipper tape of the invention, the zipper tape being provided on an inner surface of the bag body.

In the above aspect of the invention, since the packaging bag is provided with the above-described zipper tape, the packaging bag prevents the content from leaking out beyond the engaging portion toward the top seal. Moreover, since the packaging bag is provided with the above-described zipper tape, an easily-openable packaging bag can be obtained.

In the packaging bag with the zipper tape of the invention, the belt-like bases may be bonded to the inner surface of the bag body with a surface opposite to the engagement-portion formation surface.

With this arrangement, since the specified surface of the belt-like base is bonded to the inner surface of the bag body, the stress applied in opening the packaging bag further concentrates on the cutting portion. Accordingly, the cutting portion can be more easily cut.

In the packaging bag with the zipper tape of the invention, the one of the belt-like bases may be bonded to the inner surface of the bag body with the engagement-portion formation surface and the other of the belt-like bases may be bonded to the inner surface of the bag body with the surface opposite to the engagement-portion formation surface.

With this arrangement, the surface opposite to the engagement-portion formation surface is spaced apart from the inner surface of the bag body at a predetermined distance. Accordingly, the containing space is enlarged, i.e., a so-called dead space is decreased. Moreover, an internal pressure of the packaging bag is unlikely to be applied on the cutting portion, so that the cutting portion can be prevented from being torn on impact when the packaging bag falls.

It is preferable that the seal base is linearly bonded along the cutting portion.

With this arrangement, since the seal base is linearly bonded along the cutting portion, the stress in opening the bag is likely to be applied on an entirety of the cutting portion, which facilitates opening the bag.

Moreover, it is preferable that an end surface of the seal base near the cutting portion is linearly or intermittently bonded.

With this arrangement, the end surface of the seal base near the cutting portion is linearly or intermittently bonded, so that the stress can concentrate on the cutting portion, which facilitates opening the bag.

DESCRIPTION OF EXEMPLARY EMBODIMENTS

A packaging bag with a zipper tape according to a first exemplary embodiment of the invention (hereinafter, occasionally referred to simply as "a packaging bag") will be described with reference to FIGS. 1 to 3.

Figure 1:
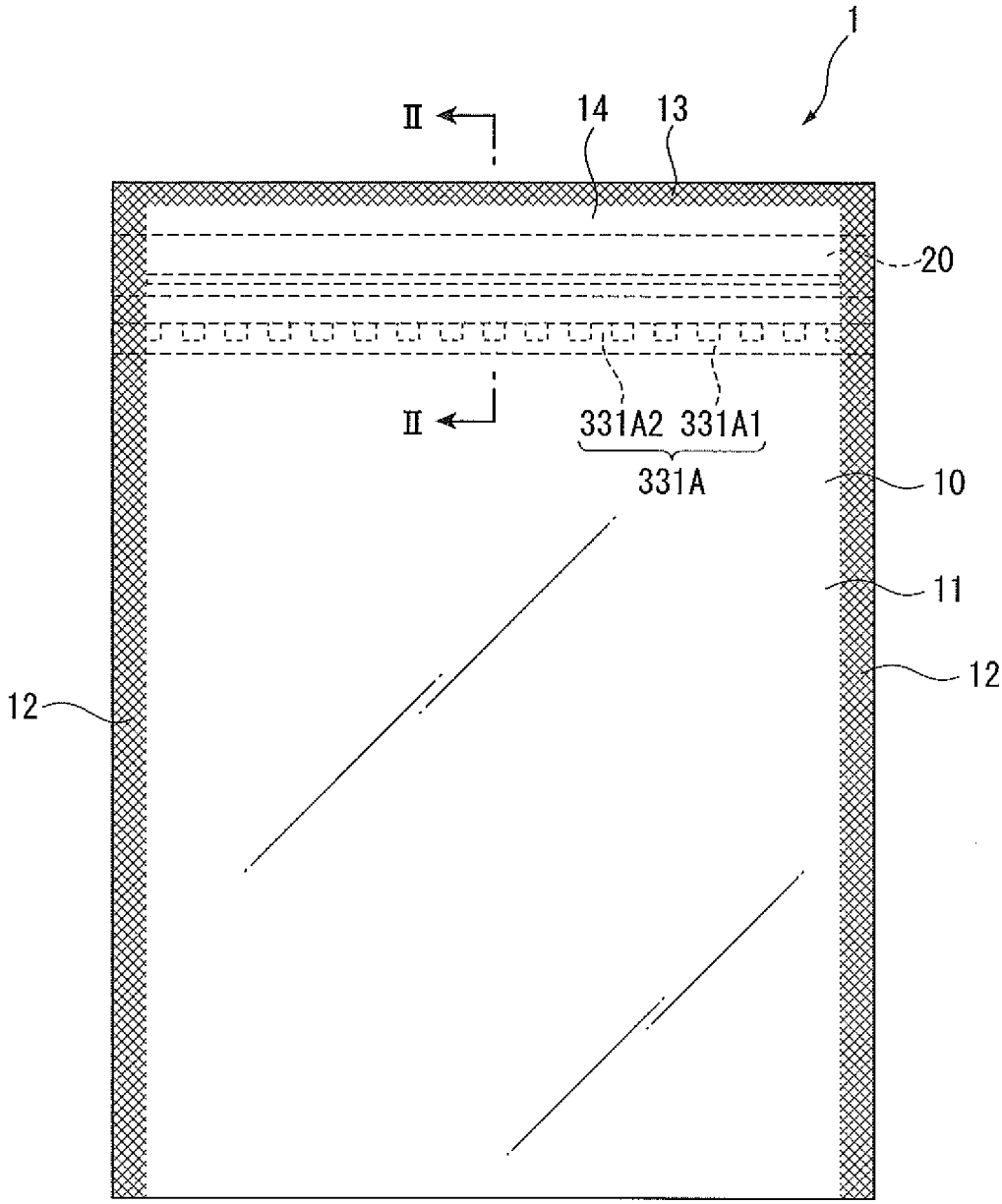
FIG. 1 is a front view showing a packaging bag with a zipper tape according to a first exemplary embodiment of the invention.

FIG. 1 is a front view showing the packaging bag with the zipper tape heat-sealed to a bag body. FIG. 2 is a cross section taken along a line II-II in FIG. 1, in which the zipper tape is heat-sealed to the bag body of the packaging bag while an engaging portion is engaged. FIG. 3 is an enlarged cross section of a seal base shown in FIG. 2.

The packaging bag of the invention is suitably filled with liquids as a content. However, the packaging bag may be filled with powders and solids.

Figure 2:
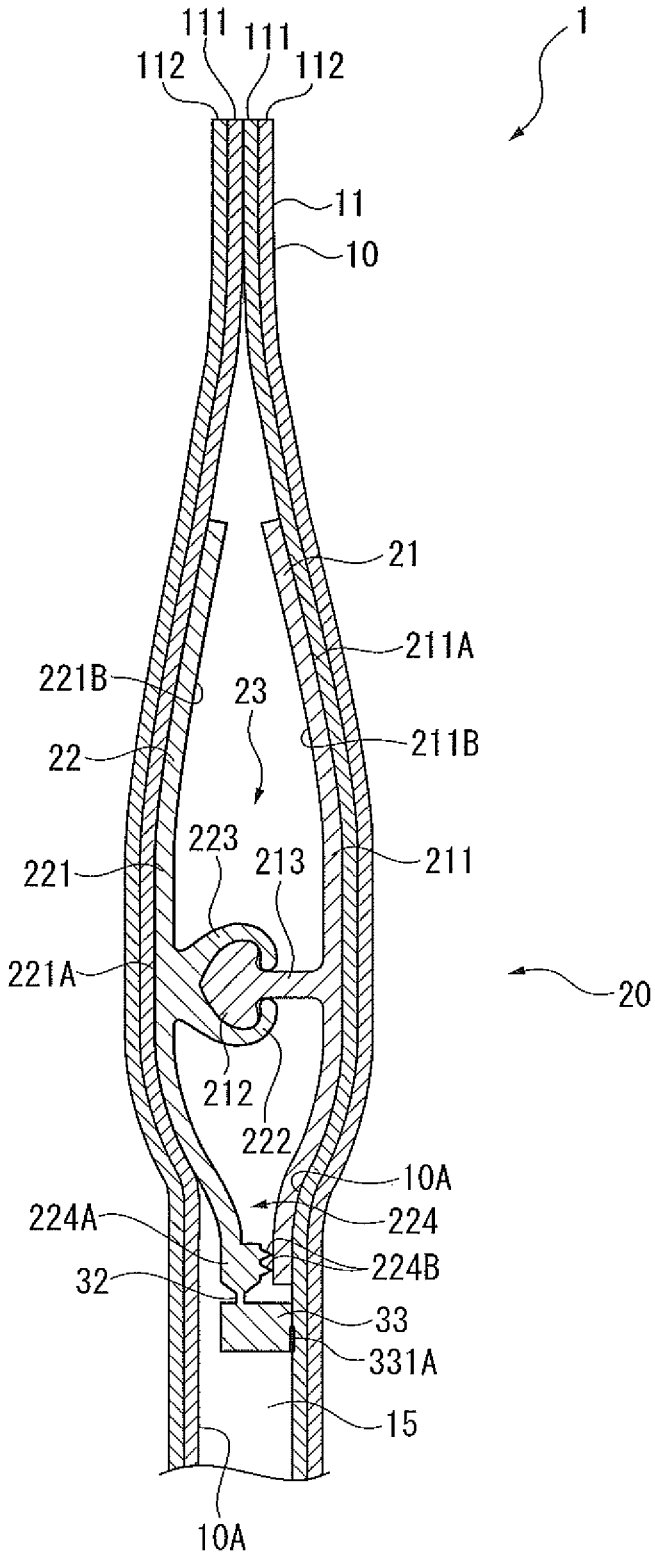
FIG. 2 is a cross section taken along the line 1141 in FIG. 1 for showing engagement of a male member and a female member.

As shown in FIGS. 1 and 2, the packaging bag 1 of this exemplary embodiment includes a bag body 10 provided by laying base films 11 (packing material) one on the other and forming side seal bases 12 and a top seal base 13 on the periphery of the base films. A zipper tape 20, which includes a pair of a male member 21 and a female member 22 including an engaging portion 23 and belt-like portions 211 and 221 continuously connected to the engaging portion 23, is attached to an inner surface 10A of an opening portion 14 of the bag body 10. The zipper tape 20 is sealed to the bag body 10 in a belt from one of the side seal bases 12 to the other of the side seal bases 12. The engaging portion 23 of the zipper tape 20 defines a containing space 15 inside the packaging bag 1.

Figure 3:
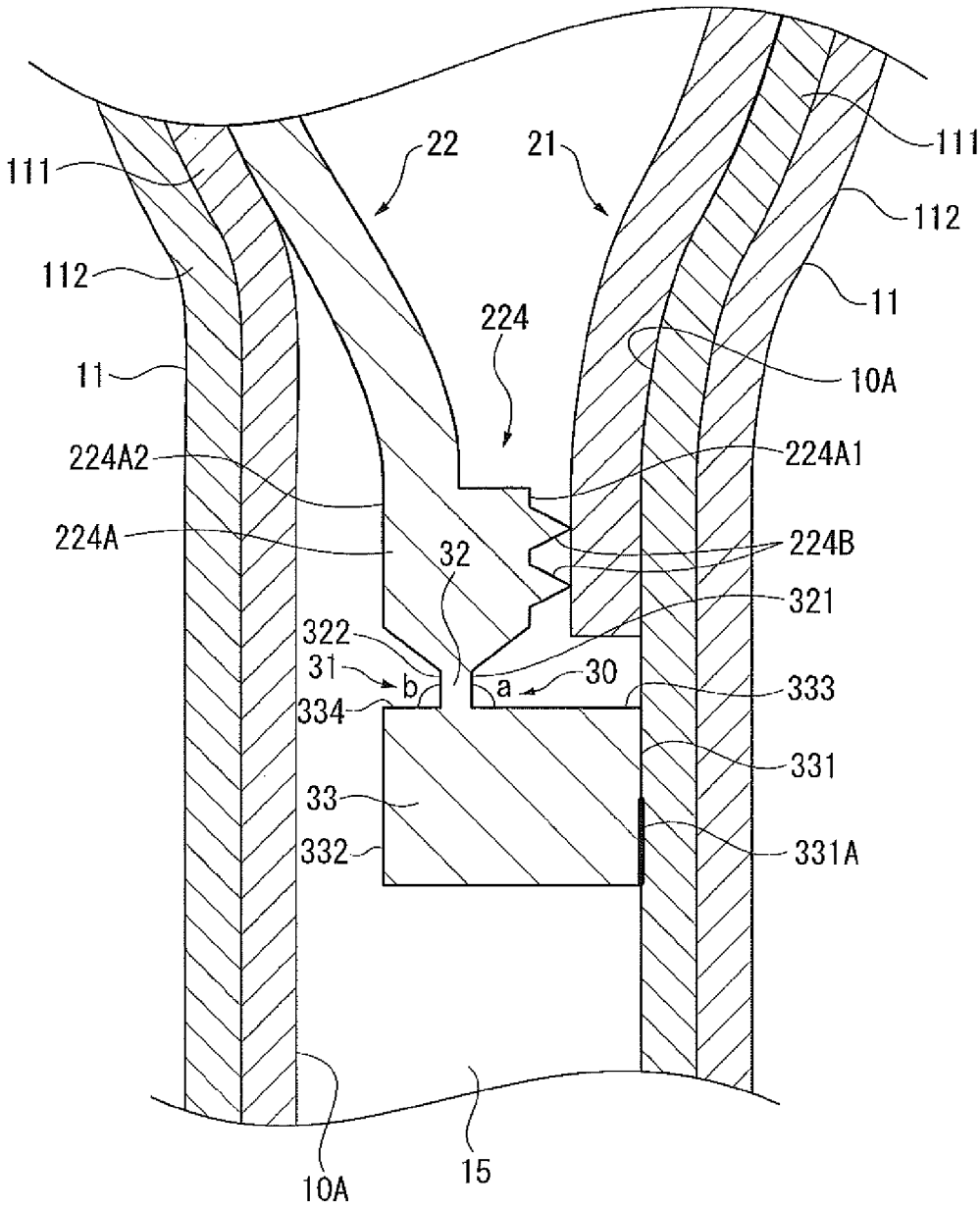
FIG. 3 is an enlarged cross section of a seal base of the zipper tape in FIG. 2.

In FIGS. 1 to 3, after the content (not shown) is put through a bottom of the bag body 10, the bottom side of the packaging body 10 is sealed, whereby the packaging bag 1 is hermetically sealed.

In use, a user cuts the opening portion 14 to open the packaging bag 1, and reseals the packaging bag with the zipper tape 20.

As shown in the cross section in FIG. 2, the zipper tape 20 includes the male member 21 provided on one side and the female member 22 provided to the other side to engage with the male member 21, the male and female members 21 and 22 each formed of a thermoplastic resin and having a belt-like shape.

The male member 21 includes: a belt-like base 211 sealed to the bag body 10; a head 212 shaped substantially in mushroom in cross section; and a connecting portion 213 for connecting the belt-like base 211 and the head 212. The belt-like base 211, the head 212 and the connection portion 213 integrally forms the male member 11.

Similarly to the above-described male member 21, the female member 22 includes: a belt-like base 221 sealed to the bag body 10; and a first hook 222 and a second hook 223 that are each arcuately shaped in cross section and connected to the belt-like base 221. The first and second hooks 222 and 223 face each other.

The belt-like base 211 of the male member 21 includes: a base facing surface 211A sealed to substantially face the inner surface 10A of the bag body; and an engagement-portion formation surface 211B near the engaging portion 23 opposite to the base facing surface 211A. The belt-like base 221 of the female member 22 includes: a base facing surface 221A sealed to substantially face the inner surface 10A of the bag body; and an engagement-portion formation surface 221B near the engaging portion 23 opposite to the base facing surface 221A.

In the zipper tape 20, the head 212 of the male member 21 and the first and second hooks 222, 223 of the female member 22 provide the engaging portion 23. The packaging bag is opened and resealed by engaging and releasing the head 212 and the first and second hooks 222 and 223.

The belt-like base 221 integrally formed with the female member 22 includes a thick portion 224A, which is thicker than the belt-like base 221, at an end 224 of the bag body 10 near the containing space 15. A seal base 33 is continuously connected to an end of the thick portion 224A near the containing space 15 via a belt-like cutting portion 32. The seal base 33 is formed thicker than the belt-like base 221 and is sealed to the inner surface 10A of the bag body 10. The cutting portion 32 is formed thinner than the thick portion 224A and separates the containing space 15 from the outside.

The thick portion 224A is formed in a belt from one of the side seal bases 12 to the other of the side seal bases 12. A thickness of the thick portion 224A is preferably in a range of 200 μm to 500 μm, more preferably in a range of 300 μm to 400 μm. When the thickness of the thick portion 224A is less than 200 μm, the stress applied in opening the packaging bag 1 is less likely to concentrate on the cutting portion 32. On the other hand, when the thickness of the thick portion 224A is more than 500 μm, the side seal base 12 is difficult to be formed.

The thick portion 224A includes a thick outer portion 224A1 near the outside and a contained thick surface 224A2 near the containing space 15. A plurality of protrusions 224B protrude from the thick outer surface 224A1. The protrusions 224B are not limited in terms of the number and a shape as long as the belt-like base 211 of the male member 21 and the belt-like base 221 of the female member 22 are not sealed to each other. However, when a height of the protrusions 224B is less than 5 μm, the belt-like base 211 of the male member 21 and the belt-like base 221 of the female member 22 may be sealed to each other. When the height of the protrusions 224B is more than 300 μm, the side seal base 12 is difficult to be formed to the packaging bag 1.

The cutting portion 32 is formed in a belt from one of the side seal bases 12 to the other of the side seal bases 12. A thickness of the cutting portion 32 is preferably in a range of 10 μm to 80 μm, more preferably in a range of 30 μm to 60 μm. When the thickness of the cutting portion 32 is less than 10 μm, the cutting portion 32 may be cut on impact when the packaging bag 1 falls. On the other hand, when the thickness of the cutting portion 32 is more than 80 μm, the cutting portion 32 may be difficult to be cut by hand.

A width of the cutting portion 32, i.e., a dimension in a direction substantially orthogonal to a longitudinal direction of the zipper tape 20 (i.e., a vertical direction of FIG. 3), is preferably in a range of 0.5 mm to 1.5 mm, more preferably in a range of 0.8 mm to 1.2 mm. When the cutting portion 32 has a width of less than 0.5 mm, in sealing the zipper tape 20 to the bag body 10, it is difficult to position the zipper tape 20 and the bag body 10 so as not to bond the cutting portion 32 to the belt-like base 211 of the male member 21 or to the inner surface 10A of the bag body. Occasionally, the end 224 near the containing space 15 of the belt-like base 221 continuously connected to the cutting portion 32 may be sealed to the belt-like base 211 of the male member 21 or to the inner surface 10A of the bag body. On the other hand, when the width of the cutting portion 32 exceeds 1.5 mm, in cutting the cutting portions 32, the cutting portion 32 may be stretched and is difficult to be cut.

The cutting portion 32 includes a cutting outer surface 321 near the outside and a contained cutting surface 322 near the containing space 15.

The seal base 33 includes: a seal facing surface 331 located near the end of the belt-like base 211 of the male member 21; and a contained seal surface 332 opposite to the seal facing surface 331 and near the containing space 15. A seal surface 331A to be sealed to the inner surface 10A of the bag body is formed on the seal facing surface 331.

As shown in FIG. 1, the seal surface 331A includes: a linear seal surface 331A1 that is linearly sealed along a longitudinal direction (a horizontal direction of FIG. 1) of the cutting portion 32; and a plurality of end seal surfaces 331A2 that are continuously formed with the linear seal surface 331A1 and to which end surface of the seal base 33 is intermittently sealed to provide a comb-shape seal. The linear seal surface 331A1 prevents leakage of the content and the plurality of end seal surfaces 331A2 allow the stress to concentrate on the cutting portion 32.

The cutting outer surface 321 and the thick outer surface 224A1 are spaced apart from the inner surface 10A of the bag body at a predetermined distance and are not sealed to the inner surface 10A of the bag body. Moreover, the contained seal surface 332, contained cutting surface 322 and contained thick surface 224A2 are also spaced apart from the inner surface 10A of the bag body at a predetermined distance and are not sealed to the inner surface 10A of the bag body.

The seal base 33 includes: a seal outer continuous surface 333 continuous with the seal facing surface 331 and the cutting outer surface 321; and a contained seal continuous surface 334 continuous with the contained seal surface 332 and the contained cutting surface 322. The cutting outer surface 321 and the seal outer continuous surface 333 form a first linking portion 30. The contained cutting surface 322 and the contained seal continuous surface 334 form a second linking portion 31. Angles of first and second corners a and b respectively corresponding to the first and second linking portions 30 and 31 preferably are 110 degrees or less, more preferably 80 degrees or less. When the angles of the first and second corners a and b are more than 110 degrees, in opening the bag, a resin may be supplied from the seal base 33 to the cutting portion 32, whereby the cutting portion 32 may be difficult to be cut. Since the angles of the first and second corners a and b are respectively 110 degrees or less, the resin supply from the seal base 33 to the cutting portion 32 in opening the bag is reliably prevented. The angles of the first and second corners a and b may be different. The first and second corners a and b may be curved at an extent caused by swell.

The male member 21 of the zipper tape 20 according to this exemplary embodiment is obtainable by integrating the head 212 and the connecting portion 213 continuous with the belt-shaped base 211 by coextrusion molding. Likewise, the female member 22 is also obtainable by integrating the first hook 222 and second hook 223 continuous with the belt-shaped base 221 by coextrusion molding. When the zipper tape 20 is formed by such coextrusion molding, the zipper tape 20 can be manufactured in a simplified process at low cost, and can be stably manufactured in a continuous manner.

The male member 21 and female member 22 of the zipper tape 20 may be formed of polyethylene and polypropylene and are preferably formed of polypropylene that is resistant to extension. Specifically, thermoplastic resins such as homo-polypropylene, block-polypropylene, random polypropylene (RPP), propylene-ethylene-butene-1 random terpolymer and polyolefin-based special flexible resins (TPO resins such as prime polymer TPO), and a mixture thereof are usable.

When random polypropylene (RPP) is used as the resin forming zipper tape 20, a melt flow rate (MFR) of RPP is preferably from 0.5 to 20 g/10 minutes, particularly preferably from 1 to 15 g/10 minutes. The MFR of the random polypropylene of below 0.5 g/10 min may degrade extrusion-moldability of the engaging portion 23 that is formed continuously from and integrally with the belt-like bases 211 and 221. On the other hand, the MFR exceeding 20 g/10 min may cause ends of the first and second hooks 222 and 223 of the female member 22 to be likely closed or may cause the connecting portion 213 of the male member 21 to be likely tilted down, which may make it difficult to extrude the zipper tape 20 into a predetermined reopenable/resealable shape.

By sealing the zipper tape 20 to a base film 11 of the bag body 10 and forming the base film 11 into a bag, the packaging bag 1 as shown in FIG. 1 can be obtained.

While the base film 11 (packaging material) for forming the bag body 10 is preferably a layered film in which a sealant layer 111 is layered onto a base layer 112, the base film 11 may be a layered film in which a layered film layer (not shown) including layers of a gas barrier layer, a light-shielding layer and a strength-reinforcing layer is provided as a middle layer between the base layer 112 and the sealant layer 111, depending on a required performance.

Examples of the material for the base layer 112 are preferably a biaxially-oriented polypropylene film (OPP film), a biaxially-oriented polyester film such as biaxially-oriented polyethylene terephthalate film (PET film) and biaxially-oriented polyethylene naphthalate film and a biaxially-oriented polyamide film such as nylon 6, nylon 66 and MXD6 (poly-meta-xylylene adipamide). Depending on needs, various engineering plastic films are also usable. One of the above may be singularly used, or a combination of two or more of the above may be layered in use.

When the middle layer is a gas barrier layer, usable examples of the material for the middle layer are a film of saponified ethylene-vinyl acetate copolymer (EVOH) or polyacrylonitrile (PAN), aluminum foil, a deposited layer of silica, alumina or aluminum and a coating layer of PVDC.

When a deposited layer of silica, alumina or aluminum or a coating layer of PVDC is used, such a layer may be deposited or applied on the inner surface 10A of the bag body of the base layer 112. Alternatively, such a layer may be preliminarily deposited or applied on another biaxially-oriented nylon film (ONy film), biaxially-oriented polyethylene terephthalate film (PET film) or biaxially-oriented polypropylene film (OPP film), and the film may be layered on the middle layer.

Among the above, aluminum foil and a deposited layer of aluminum, which are opaque, can also serve as a light-shielding layer.

The layering of the base layer 112 and the films of the middle layer can be conducted by a known dry lamination method or extrusion lamination method (sandwich lamination method).

For the sealant layer 111 (the innermost layer), polypropylene (CPP) and the like are usable.

In order to layer the sealant layer 111, the above resins may be formed into films and layered by a dry lamination method or extrusion lamination method. Alternatively, the above resins may be layered thereon by extrusion coating.

The packaging bag 1 according to this exemplary embodiment can be easily manufactured with use of, for instance, a later-described bag-making machine for three-sided sealing and attaching the zipper tape 20.

Sealing conditions (temperature, pressure, etc.) in the manufacturing can be properly determined depending on types of the resins for forming the zipper tape 20 and the base film 11 forming the bag body 10 and the like.

Next, description will be made on how the packaging bag 1 according to this exemplary embodiment is opened with reference to FIGS. 2, 4 and 5.

In FIG. 2, the male member 21 and the female member 22 of the zipper tape 20 are in engagement with each other. In this engagement, at a lower side of the engaging portion 23 (i.e., near the containing space 15) in FIG. 2, the seal surface 331A of the seal base 33 is sealed to the inner surface 10A of the bag body. This arrangement can maintain air-tightness and water-tightness of the bag, and liquid content can be kept from infiltrating into a gap in the engaging portion 23 of the zipper tape 20 during, for instance, transportation.

Figure 4:
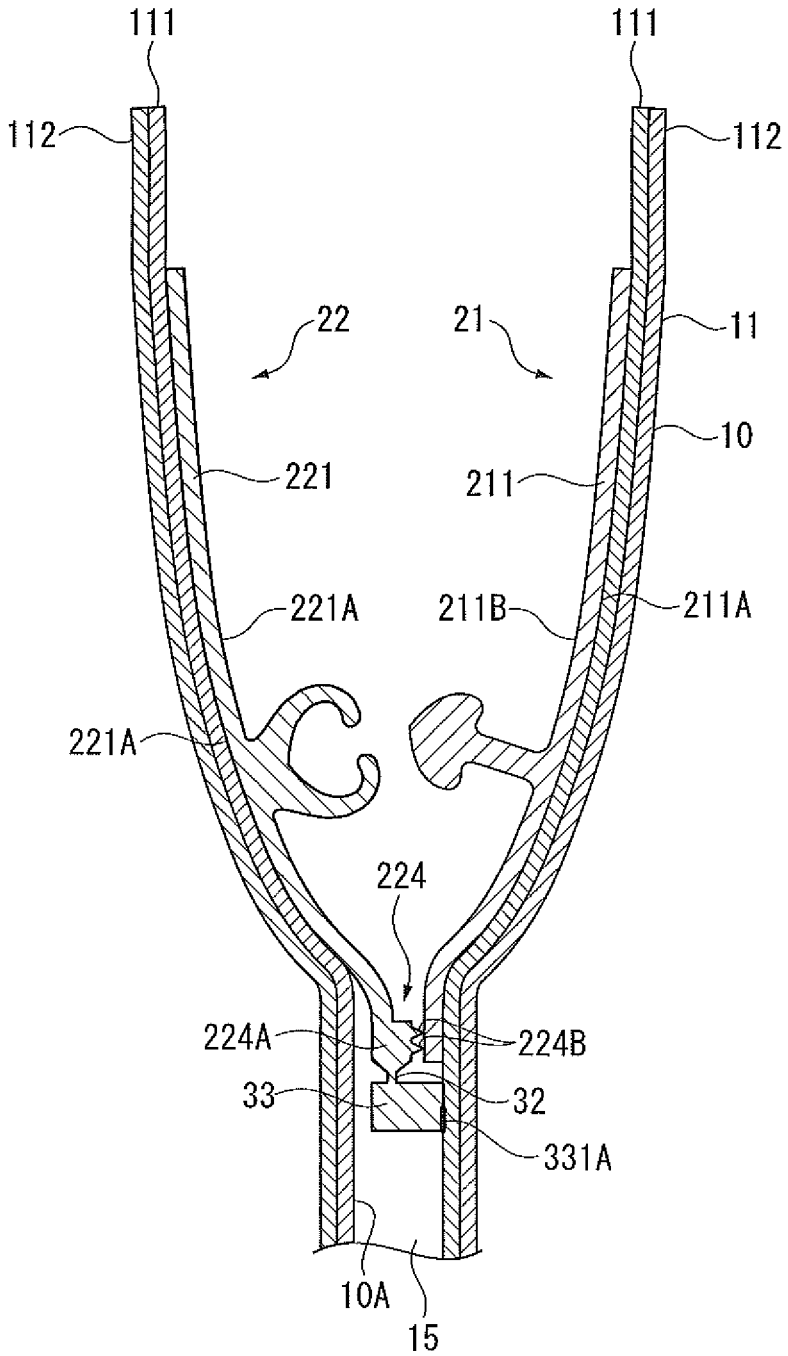
FIG. 4 is a cross section showing disengagement of the male member and the female member in FIG. 2.
Figure 5:
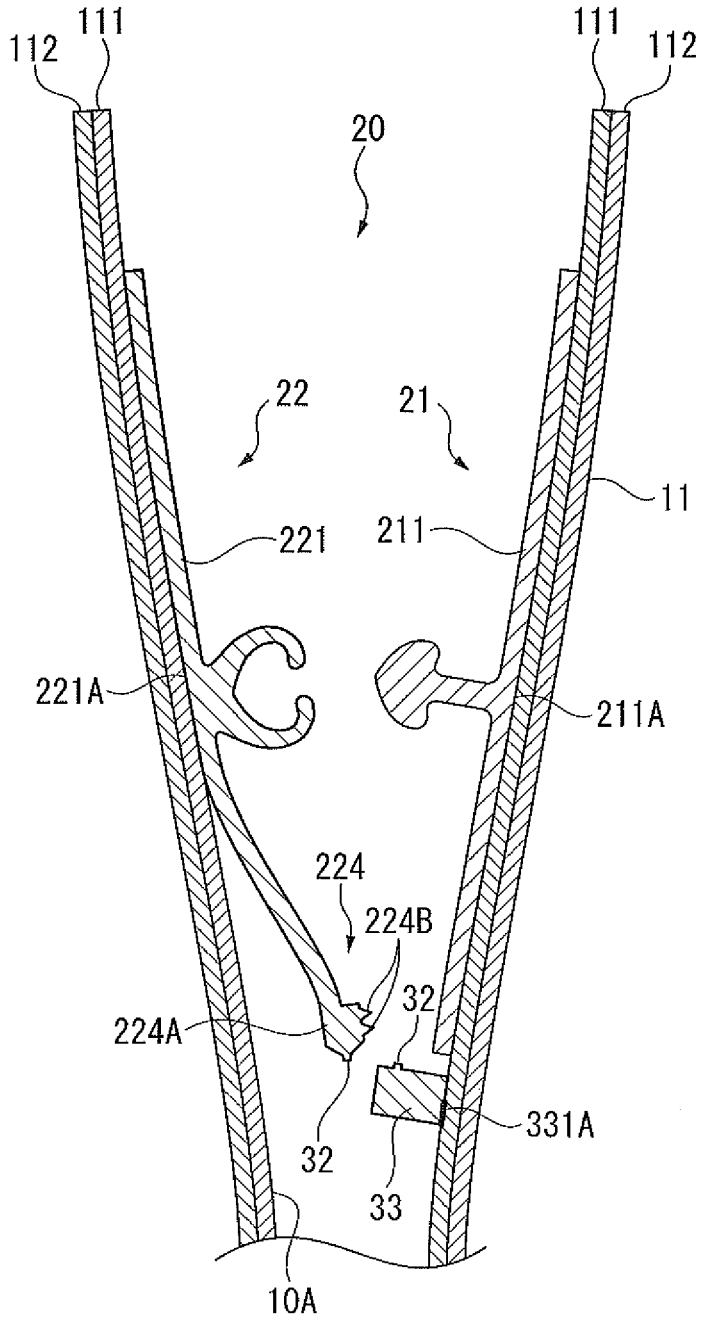
FIG. 5 is a cross section showing when the cutting portion is cut in FIG. 2.

Next, in order to remove the content from the packaging bag 1, as shown in FIG. 4, the opening portion 14 is cut to open the zipper tape 20, thereby releasing the engagement of the engaging portion 23. Subsequently, when an upper side (a side opposite to the containing space 15) of the bag body 10 is further opened, as shown in FIG. 5, the cutting portion 32 is cut by the force applied, so that the thick portion 224A and the seal base 33 are separated from each other. Thus, the content can be removed from the inside of the packaging bag 1.

Manufacturing Instrument of Packaging Bag with Zipper Tape

Next, a manufacturing instrument of the packaging bag according to the first exemplary embodiment will be described with reference to FIGS. 6 to 8.

The manufacturing instrument used for manufacturing the packaging bag 1 includes a bag-making section. FIG. 6 shows an essential portion of the bag-making section.

Figure 6:
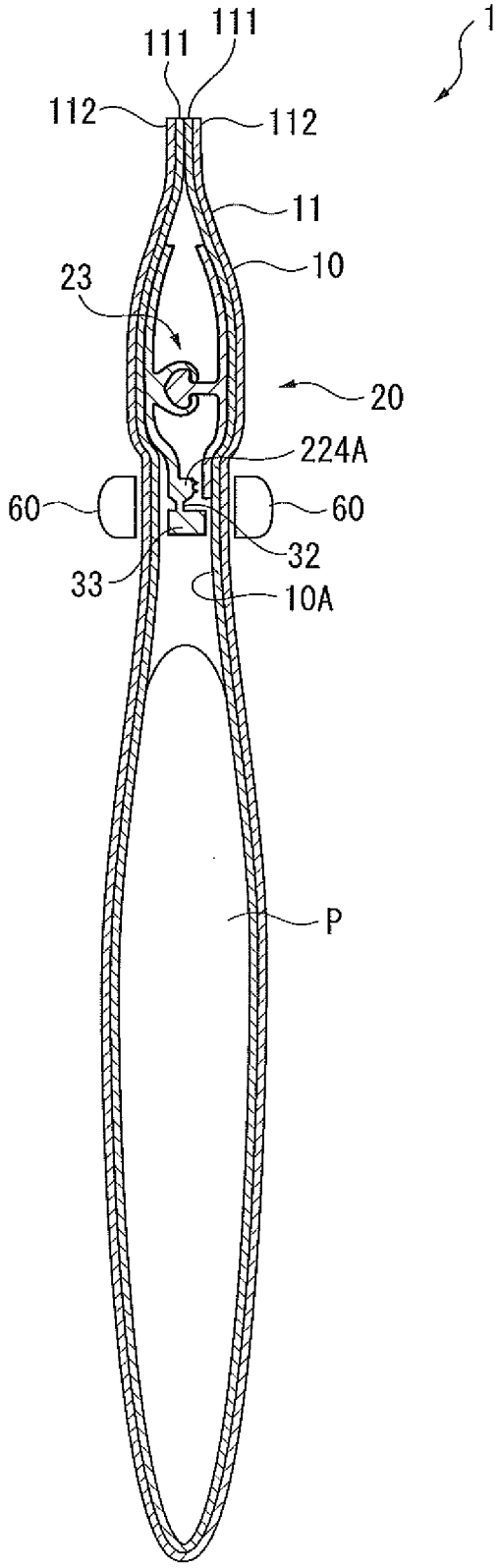
FIG. 6 is a cross section showing an essential portion of a manufacturing instrument for the packaging bag with the zipper tape according to the first exemplary embodiment.
Figure 7:
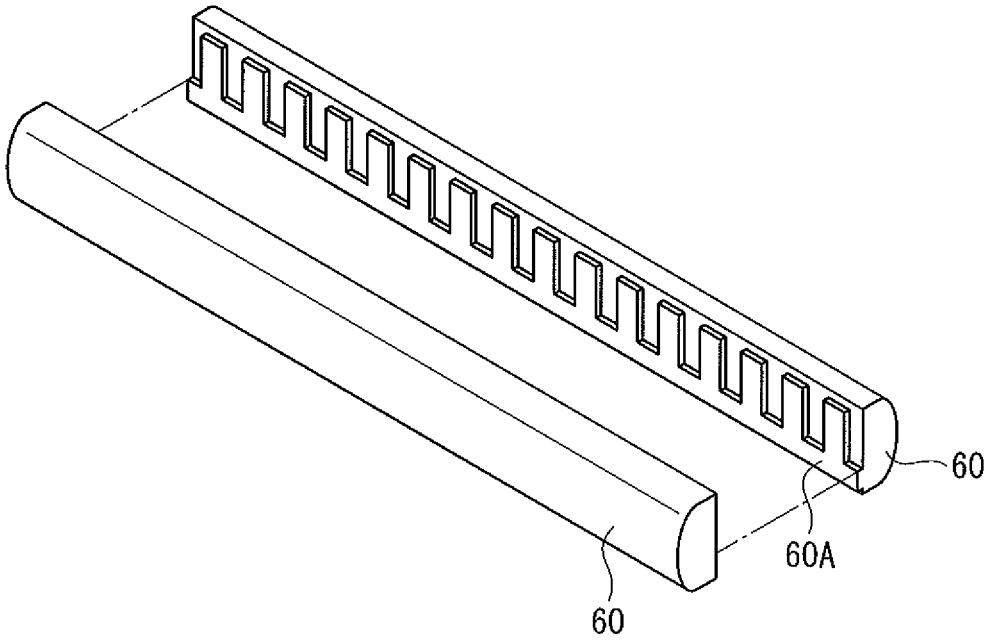
FIG. 7 is a perspective view showing a seal bar of the manufacturing instrument.

In FIG. 6, the bag-making section includes: a tape-bonding section (not shown) that positions the zipper tape 20 fed from a tape feeder (not shown) between a pair of the base films 11 fed from a packaging material feeder (not shown) and heat-seals the zipper tape 20 to both of the base films 11 at a tape attachment section; and a seal section that seals and weld-cuts the delivered base films 11 at a predetermined distance in a delivering direction of the base films 11, i.e., at a distance corresponding to a dimension in a widthwise direction of the packaging bag 1, thereby forming the packaging bag 1.

The seal section includes, a pair of seal bars 60 that are disposed to face each other with interposing the packaging bag 1 which is filled with a content P while the zipper tape 20 is fastened.

The seal bars 60 are approachable to and separable from each other. When the seal bars 60 are separated from each other, the packaging bag 1 in which the content P is contained is held at a predetermined position. At this time, when the seal bars 60 approach each other, one of the seal bars 60 is pressed on the seal base 33 via the base film 11, thereby forming the seal surface 331A on the seal base 33. As shown in FIG. 7, the one of the seal bars 60 is provided with pressing protrusions 60A in the same continuous comb-shape as the seal surface 331A. As shown in FIG. 8, the seal surface 331A of the seal base 33 is formed to have a predetermined width in the widthwise direction of the bag body 10 and a comb-shape dented at a predetermined interval in the longitudinal direction of the bag body 10. The seal bars 60 seal in such a manner that ends of the pressing protrusions 60A are beyond the cutting portion 32 to reach the thick portion 224A.

In this exemplary embodiment, when the zipper tape 20 near the containing space 15 is sealed, the seal bars 60 provided with the pressing protrusions 60A having the same shape as the seal surface 331A is used to form the seal surface 331A. Thus, the packaging bag 1 having the cutting portion 32 that can be easily cut by a force for opening the zipper tape 20 can be manufactured.

Advantages of First Exemplary Embodiment

With the above-described packaging bag 1, the following advantages can be attained.

The belt-like base 221 of the female member 22 of the zipper tape 20 is continuously connected to the seal base 33 via the belt-like cutting portion 32, the seal base 33 being thicker than the belt-like base 221 and being bondable to the inner surface 10A of the bag body 10, the cutting portion 32 being thinner than the belt-like base 221, being provided at an end near the containing space 15 of the belt-like base 221 and separating the containing space 15 from the outside. The cutting outer surface 321 of the cutting portion 32 and the seal outer continuous surface 333 of the seal base 33 form the first linking portion 30 having the first corner a. The contained cutting surface 322 of the cutting portion 32 and the contained seal continuous surface 334 of the seal base 33 form the second linking portion 31 having the second corner b.

Since the cutting portion 32 is formed in a belt thinner than the belt-like base 221, when the seal base 33 is sealed to the inner surface 10A of the bag body, the cutting portion 32 is easily positioned so as not to contact with the belt-like base 211 of the male member 21 and the inner surface 10A of the bag body. Accordingly, since the cutting portion 32 is difficult to be sealed to the inner surface 10A of the bag body, cuttability of the cutting portion 32 is not impaired. Since the cutting portion 32 is continuously connected to the seal base 33 that is sealed to the inner surface 10A of the bag body, the cutting portion 32 receives sufficient stress in cutting the cutting portion 32. Accordingly, the cutting portion 32 can be easily cut.

The zipper tape 20 provided with the first and second corners a and b prevents, in opening the bag, the resin from being supplied from the seal base 33 to the cutting portion 32 to cause the cutting portion 32 to be stretched not to be cut. In other words, in opening the bag, as compared to the arrangement without the first and second corners a and b, the stress easily concentrates on the first and second linking portions 30 and 31 to restrain the cutting portion 32 from being stretched. Accordingly, the cutting portion 32 can be easily cut. Moreover, by providing the two corners a and b to the first and second linking portions 30 and 31, the cutting portion 32 is unlikely to contact with the inner surface 10A of the bag body. Accordingly, in sealing the seal base 33, the cutting portion 32 is kept from being sealed to the inner surface 10A of the bag body.

The cutting outer surface 321 of the cutting portion 32 is formed in a belt from one of the side seal bases 12 to the other of the side seal bases 12.

Accordingly, an end of the opposing belt-like base 211 is easily positioned in line with the cutting portion 32 in order to keep the end 224 of the belt-like base 221 near the containing space 15 continuously connected to the cutting portion 32 from being sealed to the inner surface 10A of the bag body.

The angles of the first and second corners a and b are set to be 110 degrees or less.

Accordingly, since the first and second corners a and b have the specific angles, the cutting portion 32 can be easily kept from being sealed to the inner surface 10A of the bag body.

The thick portion 224A, which is thicker than the belt-like base 221, is provided at the end 224 of the belt-like base 221 near the containing space 15 continuously connected to the cutting portion 32.

Since the cutting portion 32 is continuously connected to the thick portion 224A, which is relatively thick, and the seal base 33, the stress applied in opening the bag is likely to further concentrate on the cutting portion 32, which facilitates cutting of the cutting portion 32.

The plurality of protrusions 224B are provided on the thick outer surface 224A1 of the thick portion 224A.

When the seal base 33 is sealed to the inner surface 10A of the bag body, the belt-like base 211 of the male member 21 is kept from being sealed with the belt-like base 221 of the female member 22.

The above-described zipper tape 20 is provided on the inner surface 10A of the bag body 10 that has the opening portion 14 for forming the containing space 15 in the packaging bag 1.

Since the packaging bag 1 is provided with the above-described zipper tape 20, the packaging bag 1 prevents the content from leaking out beyond the engaging portion 23 toward the top seal base 13. Moreover, since the packaging bag 1 is provided with the above-described zipper tape 20, the easily-openable packaging bag 1 can be obtained.

Both of the belt-like bases 211 and 221 of the male and female members 21 and 22 are bonded to the inner surface 10A of the bag body with the base facing surface 211A and 221A opposite to the engagement-portion formation surfaces 211B and 221B.

Accordingly, the stress in opening the packaging bag 1 is more likely to be applied to the cutting portion 32. Consequently, the cutting portion 32 can be further easily cut to open the packaging bag 1.

The linear seal surface 331A1 that is linearly bonded along the cutting portion 32 is formed on the seal base 33.

Accordingly, the stress applied in opening the bag concentrates on the cutting portion 32 from one of the side seal bases 12 to the other of the side seal bases 12, thereby facilitating opening and preventing the content from leaking.

The plurality of end seal surfaces 331A2 are intermittently formed on the end surface of the seal base 33 near the cutting portion 32.

Accordingly, the stress can be concentrated on the cutting portion 32, thereby facilitating opening.

Second Exemplary Embodiment

Next, a second exemplary embodiment of the invention will be described with reference to FIG. 9.

Figure 9:
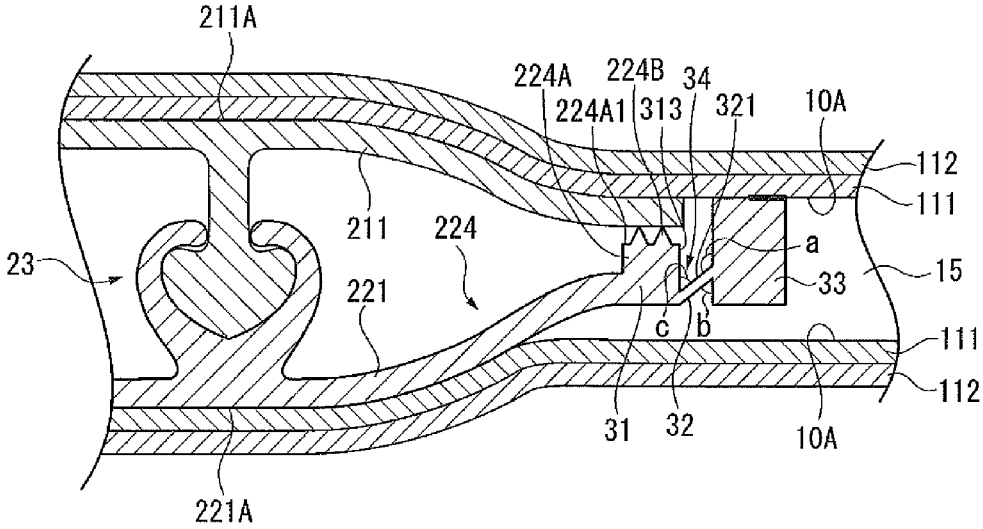
FIG. 9 is a cross section showing a zipper tape according to a second exemplary embodiment.

FIG. 9 is a cross section showing a vicinity of the cutting portion of the packaging bag according to the second exemplary embodiment of the invention.

In the second exemplary embodiment, only an arrangement different from that in the first exemplary embodiment will be described.

In the second exemplary embodiment, the thick portion 224A further includes a thick outer continuous surface 313 that is continuous with the thick outer surface 224A1 and the cutting outer surface 321. A third linking portion 34 is defined by the thick outer continuous surface 313 and the cutting outer surface 321. The third linking portion 34 has a third corner c. An angle of the third corner c is preferably 110 degrees or less.

Advantages of Second Exemplary Embodiment

In the second exemplary embodiment, the third linking portion 34 having the third corner c that is formed on the thick outer continuous surface 313 and the cutting outer surface 321 is provided in addition to the arrangement of the first exemplary embodiment.

When the bag is opened, the third corner c having the specific angle prevents the resin from being supplied from the thick portion 224A to the cutting portion 32 to cause the cutting portion 32 to be stretched not to be cut. Accordingly, the cutting portion 32 can be more easily cut.

Third Exemplary Embodiment

Next, a third exemplary embodiment of the invention will be described with reference to FIG. 10.

Figure 10:
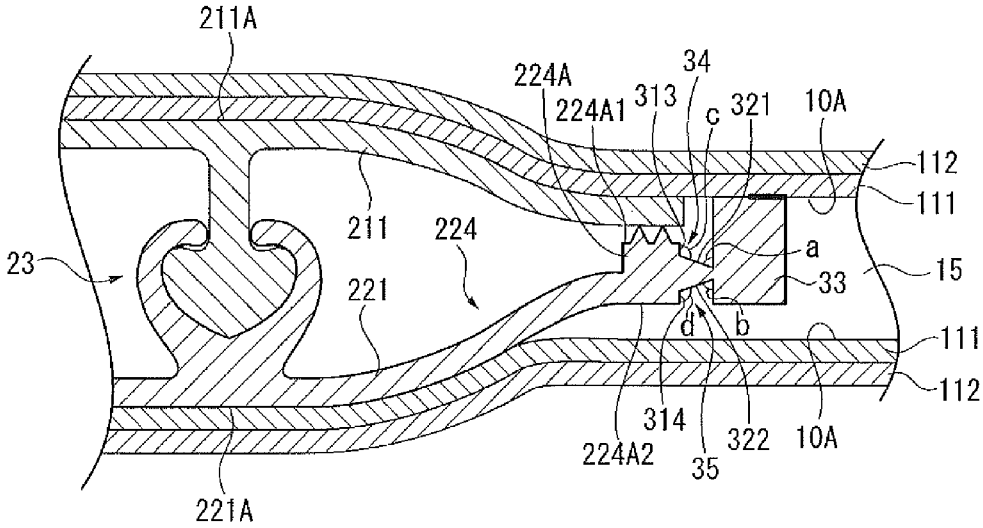
FIG. 10 is a cross section showing a zipper tape according to a third exemplary embodiment.

FIG. 10 is a cross section showing a vicinity of the cutting portion of the packaging bag according to the third exemplary embodiment of the invention.

In the packaging bag according to the third exemplary embodiment, an arrangement different from that in the second exemplary embodiment will be described.

In the third exemplary embodiment, the thick portion 224A further includes a contained thick continuous surface 314 that is continuous with the contained thick portion 224A2 and the contained cutting surface 322. A fourth linking portion 35 having a fourth corner d is defined by the contained thick continuous surface 314 and the contained cutting surface 322. An angle of the fourth corner d is preferably 110 degrees or less.

Advantages of Third Exemplary Embodiment

In the third exemplary embodiment, the fourth linking portion 35 having the fourth corner d is provided to the zipper tape 20 in addition to the arrangement of the second exemplary embodiment.

When the bag is opened, the third and fourth corners c and d having the specific angles prevents the resin from being supplied from the thick portion 224A to the cutting portion 32 to cause the cutting portion 32 to be stretched not to be cut. Accordingly, the cutting portion 32 can be more easily cut. Since the fourth linking portion 35 is provided, when the seal base 33 is sealed to the inner surface 10A of the bag body, the cutting portion 32 is prevented from being sealed to the inner surface 10A of the bag body and the belt-like base 211 of the opposing male member 21.

Fourth Exemplary Embodiment

Next, a fourth exemplary embodiment of the invention will be described with reference to FIG. 11.

Figure 11:
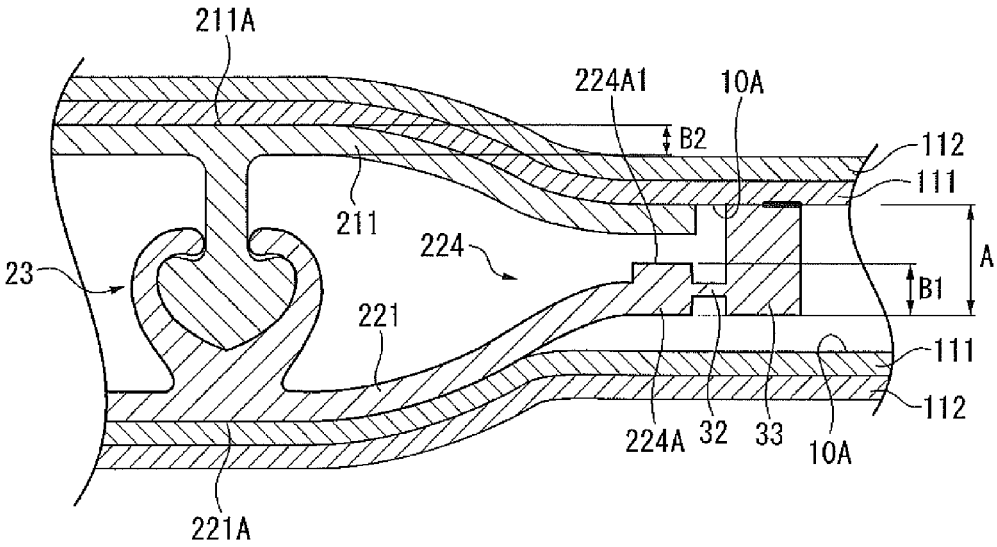
FIG. 11 is a cross section showing a zipper tape according to a fourth exemplary embodiment.

FIG. 11 is a cross sectional view showing a vicinity of the cutting portion of the packaging bag according to the fourth exemplary embodiment of the invention.

In the packaging bag according to the fourth exemplary embodiment, an arrangement different from that in the first exemplary embodiment will be described.

The thick outer surface 224A1 is provided with the protrusions 224B in the first exemplary embodiment. In contrast, the protrusions 224B are not provided in the fourth exemplary embodiment. The thick outer portion 224A1 is spaced apart from the opposing belt-like base 211 of the male member 21 at a predetermined distance.

When the seal base 33, the thick portion 224A provided to the belt-like base 221 of the female member 22 and the belt-like base 211 of the male member 21 respectively have a thickness of A, B1 and B2, A≥(B1+B2) is satisfied.

Advantages of Fourth Exemplary Embodiment

In the fourth exemplary embodiment, the thick outer portion 224A1 is spaced apart from the opposing belt-like base 211 of the male member 21 at a predetermined distance.

When the seal base 33 is sealed to the inner surface 10A of the bag body, the thick portion 224A is kept from being sealed to the belt-like base 211 of the male member 21.

Since the thickness of the seal base 33 is larger than the total thickness of the thick portion 224A provided to the belt-like base 221 of the female member 22 and the belt-like base 211 of the male member 21, the seal base 33 is reliably sealed to the inner surface 10A of the bag body. Accordingly, in opening the bag, the cutting portion 32 is likely to receive the stress to be easily cut.

Fifth Exemplary Embodiment

Next, a fifth exemplary embodiment of the invention will be described with reference to FIG. 12.

Figure 12:
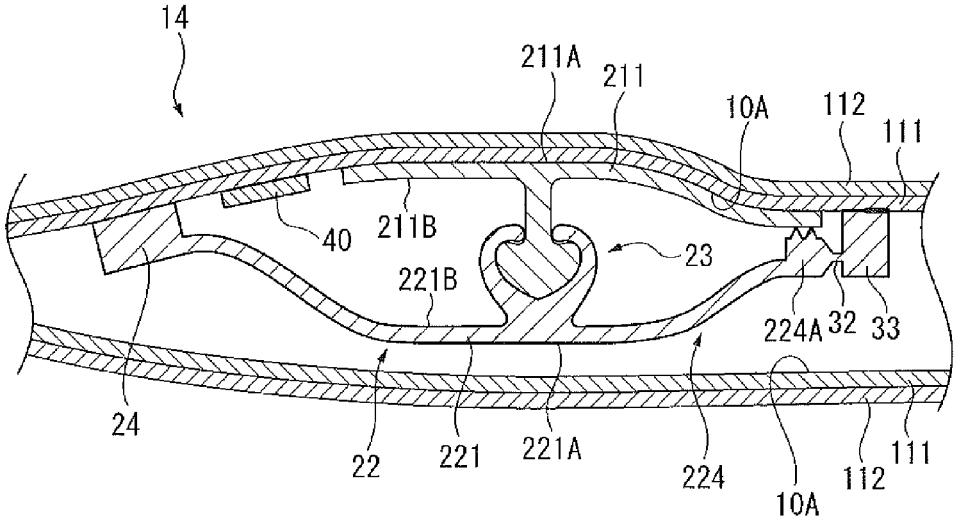
FIG. 12 is a cross section showing a zipper tape according to a fifth exemplary embodiment.

FIG. 12 is a cross sectional view showing a vicinity of the zipper tape of the packaging bag according to the fifth exemplary embodiment of the invention.

In the fifth exemplary embodiment, an arrangement different from that in the first exemplary embodiment will be described.

In the fifth exemplary embodiment, the belt-like base 221 of the female member 22 includes a seal base 24 at an end near the opening 14. The belt-like base 221 of the female member 22 is bonded to the inner surface 10A of the bag body near the male member 21 with the engagement-portion formation surface 211B via the seal base 24. An opening tape 40 is attached between the seal base 24 and the belt-like base 211 of the male member 21.

The base facing surface 221A opposite to the engagement-portion formation surface 211B is spaced apart from the inner surface 10A of the bag body at a predetermined distance. In other words, the belt-like base 221 of the female member 22 is not sealed to the inner surface 10A of the bag body.

Advantages of Fifth Exemplary Embodiment

In the fifth exemplary embodiment, the belt-like base 211 of the male member 21 is bonded to the inner surface 10A of the bag body with the base facing surface 211A opposite to the engagement-portion formation surface 211B, and the belt-like base 221 of the female member 22 is bonded to the inner surface 10A of the bag body with the engagement-portion formation surface 221B.

Accordingly, the base facing surface 221A is spaced apart from the inner surface 10A of the bag body at a predetermined distance. With this arrangement, the containing space is enlarged, i.e., a so-called dead space is decreased, so that the packaging bag 1 can contain larger amount of contents. Moreover, an internal pressure of the packaging bag 1 is unlikely to be applied on the cutting portion 32, so that the cutting portion 32 can be prevented from being torn on impact when the packaging bag 1 falls.

Sixth Exemplary Embodiment

Next, a sixth exemplary embodiment of the invention will be described with reference to FIG. 13.

Figure 13:
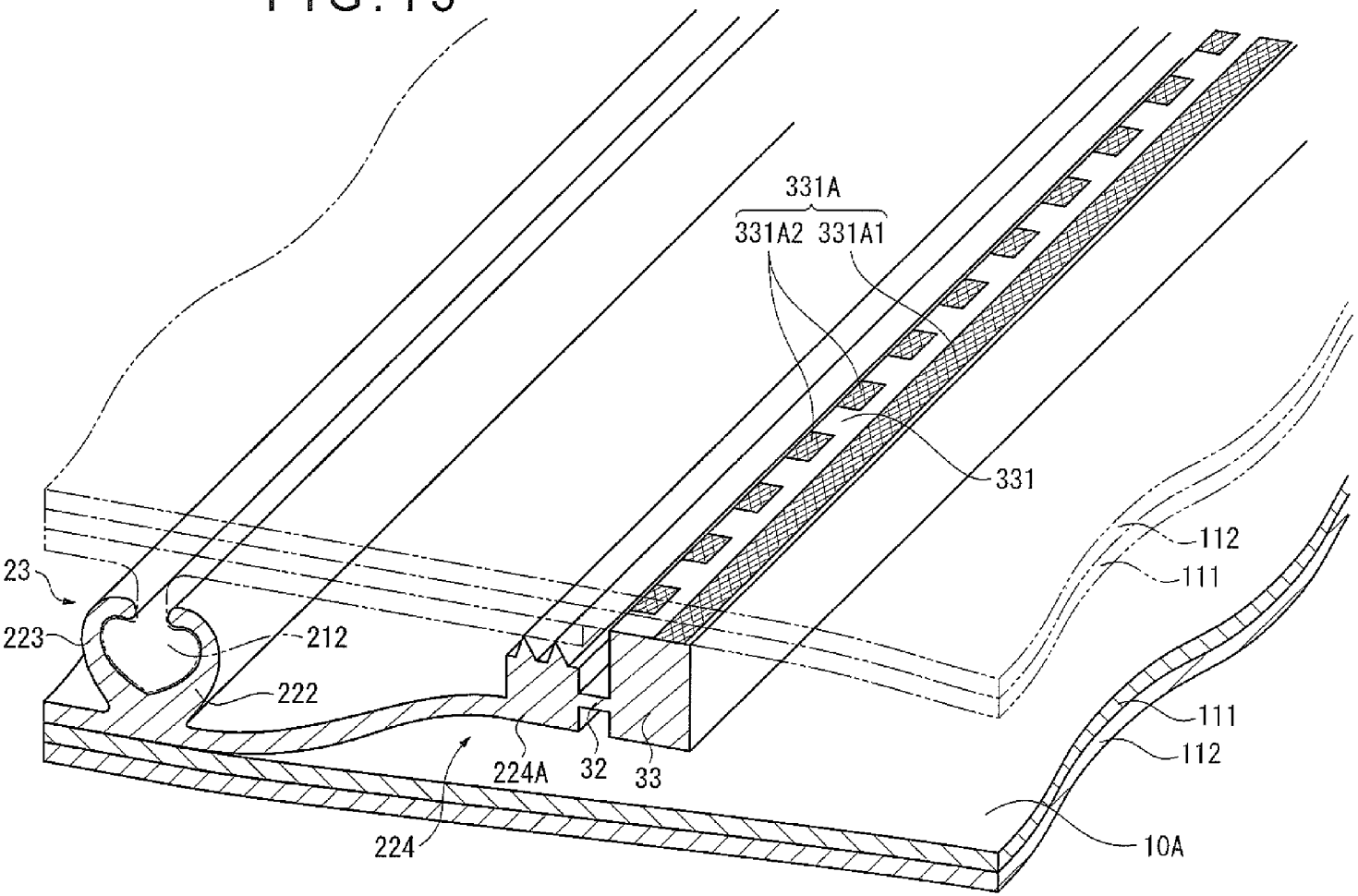
FIG. 13 is a perspective view showing a zipper tape according to a sixth exemplary embodiment.

FIG. 13 is a cross sectional view showing a vicinity of the cutting portion of the packaging bag according to the sixth exemplary embodiment of the invention.

In the sixth exemplary embodiment, an arrangement different from that in the first exemplary embodiment will be described.

Although the seal surface 331A in a comb-shape is formed in the first exemplary embodiment, in the sixth exemplary embodiment, the seal surface 331A includes: a linear seal surface 331A1 to be linearly sealed from one of the side seal bases 12 to the other of the side seal bases 12 along the longitudinal direction of the cutting portion 32; and a plurality of end seal surfaces 331A2, which are not continuous with the linear seal surface 331A1, to which end surfaces of the seal base 33 are sealed in a dashed line. The linear seal surface 331A1 prevents leakage of the content and the plurality of end seal surfaces 331A2 allow the stress to concentrate on the cutting portion 32.

Advantages of Sixth Exemplary Embodiment

Although the seal surface 331A in the sixth exemplary embodiment has a smaller area than the seal surface 331A in the first exemplary embodiment, similarly to the seal surface 331A in the first exemplary embodiment, partial formation of the end seal surfaces 331A2 that seal the ends of the seal base 33 to the cutting portion 32 provides the stress-concentrated portions on the cutting portion 32, thereby facilitating opening the bag.

EXAMPLES

Now, the invention will more specifically be described by providing examples and comparisons, the content of which by no means limits the present invention.

Example 1

With use of random polypropylene having MFR of 7 and a melting point of 140 degrees C., the zipper tape shaped as shown in FIG. 2 was manufactured under the following conditions. It should be noted that although the protrusions are formed on the thick portion in FIG. 2, no protrusion was formed in Example 1.

Arrangement of Zipper Tape

Thickness of Thick Portion: 300 μm

Thickness of Cutting Portion: 40 μm Width of Cutting Portion: 0.5 mm

Angle of Each of First and Second Corners: 110 degrees

Thickness of Belt-like Portion of Male Member: 150 μm

Thickness of Belt-like Portion of Female Member: 200 μm

Thickness of Seal Base: 400 μm

The thickness refers to a dimension in a horizontal direction in FIG. 2. The width refers to a dimension in a vertical direction in FIG. 2.

Arrangement of Bag Body

The base film forming the bag body, which was a film provided by dry-laminating the biaxially-oriented polyester film (12 μm), the biaxially-oriented nylon film (15 μm) and a cast polypropylene film (60 μm), was used for manufacturing the bag as shown in FIG. 2.

Figure 8:
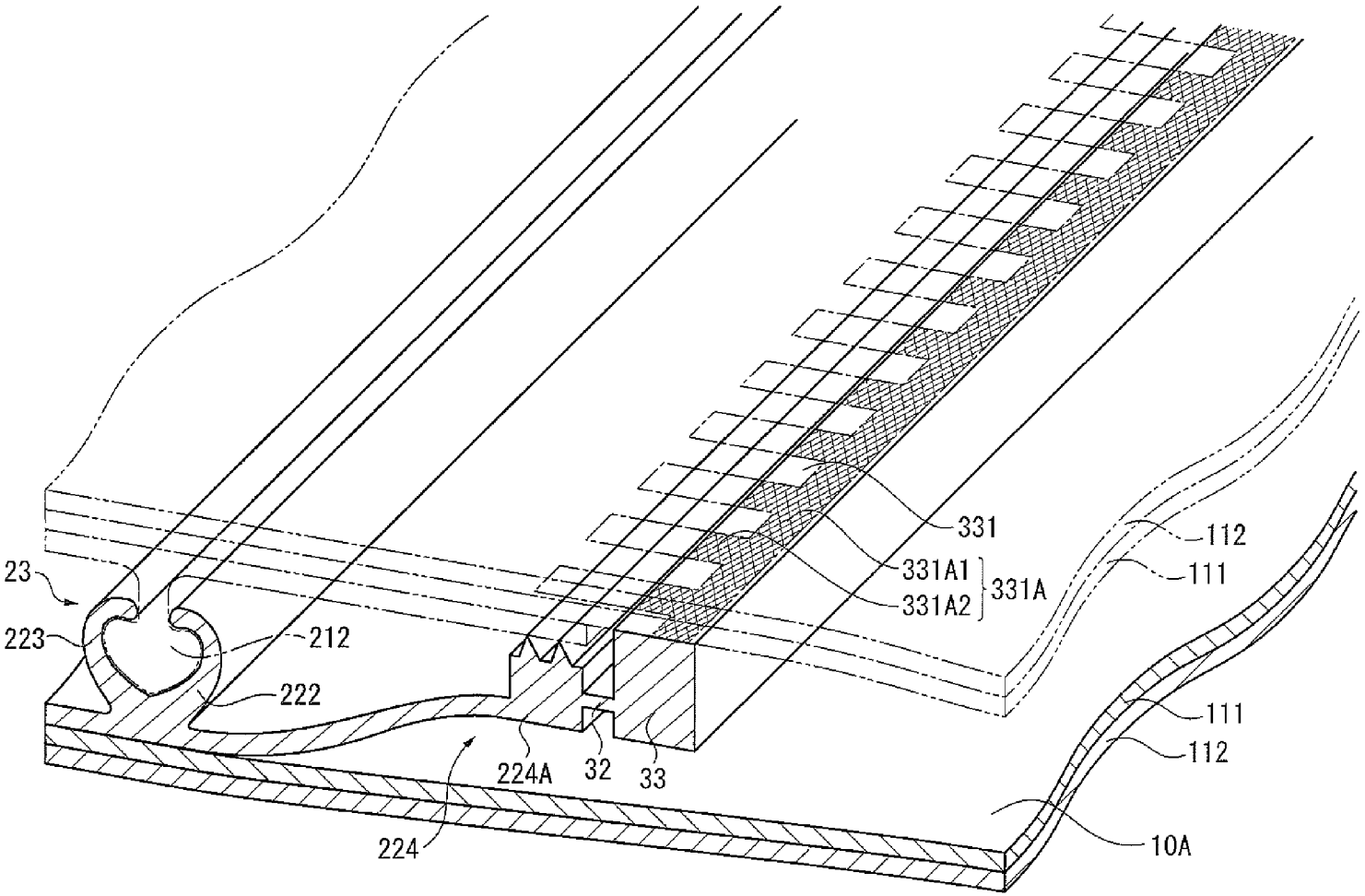
FIG. 8 is a cross section showing a seal end formed by the seal bar.

As shown in FIG. 8, the seal base was sealed at a 1-mm width in the widthwise direction of the bag (the direction orthogonal to the longitudinal direction of the zipper tape) and was sealed by the comb-shaped seal bar having a 1-mm width and 10-mm intervals in the longitudinal direction of the zipper tape in such a manner that ends of the comb were beyond the cutting portion to reach the thick portion.

An inner size of the bag from the seal of the seal base to the bottom of the containing space was set to be a width of 180 mm and a depth of 200 mm.

Example 2

With use of the zipper tape shaped as shown in FIG. 10, the packaging bag was manufactured in the same manner as that in Example 1 except that the angles c and d of the third and fourth corners were 110 degrees. It should be noted that, although the protrusions are formed on the thick portion in FIG. 10, but no protrusion was formed in Example 2.

Example 3

The packaging bag was manufactured in the same manner as that in Example 2 except that the zipper tape shaped as shown in FIG. 2 was used. Three protrusions shaped in a triangular cross section having a height of 0.07 μm were formed on the thick portion of the female member.

Example 4

With use of random polypropylene having MFR of 7 and a melting point of 140 degrees C., the zipper tape shaped as shown in FIG. 12 was manufactured under the following conditions.

Arrangement of Zipper Tape

Thickness of Thick Portion: 300 μm

Thickness of Cutting Portion: 40 μm

Width of Cutting Portion: 0.5 mm

Angle of Each of First to Fourth Corners: 110 degrees

Thickness of Belt-like Portion of Male Member: 150 μm

Thickness of Belt-like Portion of Female Member: 200 μm

Thickness of Seal Base: 400 μm

The thickness refers to a dimension in a vertical direction in FIG. 12. The width refers to a dimension in a horizontal direction in FIG. 12.

The film, which was a film provided by dry-laminating the biaxially-oriented polyester film (12 μm), the biaxially-oriented nylon film (15 μm) and a cast polypropylene film (60 μm), was used for manufacturing the bag as shown in FIG. 12.

As shown in FIG. 8, the seal base was sealed at a 1-mm width in the widthwise direction of the bag and was sealed by the comb-shaped seal bar having a 1-mm width and 10-mm intervals in the longitudinal direction in such a manner that ends of the comb were beyond the cutting portion to reach the belt-like base.

The inner size of the bag from the seal of the seal base to the bottom was set to be a width of 180 mm and a depth of 200 mm.

Comparative 1

With use of random polypropylene having MFR of 7 and a melting point of 140 degrees C., the zipper tape shaped as disclosed in JP-A-2008-24324 (FIG. 4) was manufactured under the following conditions.

JP-A-2008-24324 (FIG. 4) discloses:

Thickness of Belt-like Bases (321, 331) of Male and Female Members: 150 μm Seal Base (36): 150 μm Thickness of Cutting Portion (Linear Portion 35): 40 μm Width of Cutting Portion (Linear Portion 35): 0.1 mm The base film, which was a film provided by dry-laminating a biaxially-oriented polyester film (12 μm), a biaxially-oriented nylon film (15 μm) and a cast polypropylene film (60 μm), was used for manufacturing the bag as shown in FIG. 2.

As shown in FIG. 8, the seal base was sealed at a 1-mm width in the widthwise direction of the bag and was sealed by the comb-shaped seal bar having a 1-mm width and 10-mm intervals in the longitudinal direction in such a manner that ends of the comb were beyond the cutting portion to reach the belt-like base. An inner size of the bag from the seal of the seal base to the bottom of the containing space was set to be a width of 180 mm and a depth of 200 mm.

Comparative 2

With use of the zipper tape shaped as shown in FIG. 2, the packaging bag was manufactured in the same manner as that in Example 1 except for the following conditions:

Angle of Each of First and Second Corners: 130 degrees

Comparative 3

With use of the zipper tape shaped as shown in FIG. 2, the packaging bag was manufactured in the same manner as that in Example 1 except for the following conditions:

Thickness of Cutting Portion: 90 μm.

The packaging bags manufactured in Examples 1 to 4 and Comparatives 1 to 3 were evaluated according to the following method. The evaluation results are shown in Table 1.

Evaluation Method (1) After the bag was manufactured, it was checked whether the cutting portion was welded to the base film of the bag body.

B: no welding

C: presence of pseudo welding

D: presence of welding (2) After the bag was manufactured, it was checked whether the belt-like bases of the male and female members were welded to each other.

A: no welding

B: presence of weak pseudo welding

C: presence of strong pseudo welding

D: presence of welding (3) Water of 400 ml was filled in the manufactured bag and the bag was sealed. The bag was dropped by 10N from a height of 1.2 m. It was checked whether the cutting portion was cut. This procedure was carried out on 50 bags in total.

B: No cut

C: Cut in one or two bags

D: Cut in three bags or more (4) The cutting portion was opened by hand.

B: easily openable

C: resistant to be opened, but openable

D: difficult to be opened (5) Total Evaluation

A: A or B all of the items

B: C for one item and A or B for the other items

C: C for two or more items and A or B for the other items

D: D for one or more items

TABLE 1

| | Suitability for bag-making | | | | |
|---|---|---|---|---|---|
| | Welding between cutting portion/bag body film | Welding between belt-like bases of male/female members | Practicability | | |
| | | | Anti-tear property of bag in fall | Feeling in opening | Total Evaluation |
| Example 1 | B | B | C | C | C |
| Example 2 | B | B | C | B | B |
| Example 3 | B | A | C | B | B |
| Example 4 | B | B | B | B | A |
| Comparative 1 | C | D | C | D | D |
| Comparative 2 | B | B | C | D | D |
| Comparative 3 | B | B | C | D | D |

As shown in Table 1, in Examples 1 to 4, there was almost no welding between the cutting portion and the base film of the bag body and between the belt-like bases of the male and female members. Thus, the manufactured bags exhibited favorable properties. Particularly, it was found from Example 3 that provision of the protrusions on the thick portion can keep the belt-like bases of the male and female members from being welded to each other. In Example 4, the seal base was continuously connected to one end of the belt-like base of the female member via the cutting portion and another seal base was provided at the other end thereof. The engagement-portion formation surface of the belt-like base was bonded to the inner surface of the bag body via the seal bases. It was found that this arrangement can prevent the cutting portion from being cut on impact when the bag falls and easily open the bag.

In contrast, in Comparative 1, in manufacturing of the bag, the cutting portion was welded to the base film and the belt-like bases of the male and female members were welded to each other. In Comparative 2, the angles of the corners of the linking portion between the cutting portion and the seal base were set to be larger than those in the preferred range of the invention (110 degrees or less), resulting in poor feeling in opening. Moreover, in Comparative 3, the thickness of the cutting portion was set to be larger than that in the preferred range of the invention (30 to 60 μm), resulting in poor feeling in opening.

The invention claimed is:

1. A zipper tape comprising:

a pair of a male member and a female member, each of the male member and the female member comprising an engaging portion capable of being engaged and disengaged to define a containing space inside a bag body and a belt-like base that is continuously connected to the engaging portion and bondable to an inner surface of the bag body, wherein one of the belt-like bases of the male member and the female member is continuously connected to a seal base via a belt-like cutting portion at a tapered end of the one of the belt-like bases positioned between the female and male members and the containing space, wherein the one of the belt-like bases is longer than the other belt-like base, wherein the longer belt-like base extends further from the male and female members in a direction toward the containing space, and wherein the seal base is attached to the end of the longer belt-like base and is bondable only to the inner surface of the bag body which is adjacent to the shorter belt-like base, and wherein the cutting portion is thinner than either of the belt-like bases, and a linking portion is positioned between the cutting portion and the seal base wherein an outside surface of the linking portion has corners.

2. The zipper tape according to claim 1, wherein the corners each have an angle of 110 degrees or less.

3. The zipper tape according to claim 1, wherein, when the seal base, the belt-like base of the male member and the belt-like base of the female member respectively have a thickness of A, B1 and B2, A≥(B1+B2) is satisfied.

4. The zipper tape according to claim 1, further comprising:

a thick portion that is provided at the end of the one of the belt-like bases near the containing space, the thick portion being thicker than the one of the belt-like bases.

5. The zipper tape according to, further comprising:

a protrusion that is formed at the end of the one of the belt-like bases near the containing space, the protrusion protruding toward an engagement-portion formation surface.

6. A packaging bag with a zipper tape, comprising:

a bag body having an opening for defining a containing space; and the zipper tape according to claim 1, the zipper tape being provided on an inner surface of the bag body.

7. The packaging bag with the zipper tape according to claim 6, wherein each of the belt-like bases is bonded to the inner surface of the bag body with a surface opposite to the engagement-portion formation surface.

8. The packaging bag with the zipper tape according to claim 6, wherein the one of the belt-like bases is bonded to the inner surface of the bag body with the engagement-portion formation surface and the other of the belt-like bases is bonded to the inner surface of the bag body with the surface opposite to the engagement-portion formation surface.

9. The packaging bag with the zipper tape according to claim 6, wherein the seal base is linearly bonded along the cutting portion.

10. The packaging bag with the zipper tape according to claim 9, wherein an end surface of the seal base near the cutting portion is linearly or intermittently bonded.

11. The packaging bag with the zipper tape of claim 6 wherein the corners have angles of about 90°.

12. The packaging bag with the zipper tape of claim 6 wherein the corners are non-rounded.

13. The packaging bag with the zipper tape of claim 1 wherein the corners have angles of about 90°.

14. The packaging bag with the zipper tape of claim I wherein the corners are non-rounded.

* * * * *